US007094731B2

(12) United States Patent
Serizawa et al.

(10) Patent No.: US 7,094,731 B2
(45) Date of Patent: Aug. 22, 2006

(54) RECORDING MATERIAL

(75) Inventors: Shinichiro Serizawa, Shizuoka-ken (JP); Yasuhiro Ogata, Shizuoka-ken (JP); Hiroshi Yamamoto, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 346 days.

(21) Appl. No.: 10/178,895

(22) Filed: Jun. 25, 2002

(65) Prior Publication Data

US 2003/0083200 A1 May 1, 2003

(30) Foreign Application Priority Data

| | | |
|---|---|---|
| Jun. 26, 2001 | (JP) | 2001-193129 |
| Jun. 26, 2001 | (JP) | 2001-193130 |
| Jun. 26, 2001 | (JP) | 2001-193131 |
| Oct. 12, 2001 | (JP) | 2001-314938 |
| Oct. 12, 2001 | (JP) | 2001-314947 |

(51) Int. Cl.
*B41M 5/38* (2006.01)

(52) U.S. Cl. ..... 503/200; 503/207; 503/226

(58) Field of Classification Search ..... 503/200, 503/207, 226

See application file for complete search history.

(56) References Cited

U.S. PATENT DOCUMENTS

| | | | |
|---|---|---|---|
| 5,064,806 | A | 11/1991 | Torii et al. |
| 5,231,068 | A | 7/1993 | Miyamoto et al. |
| 2002/0155951 | A1 | 10/2002 | Shuka et al. |

FOREIGN PATENT DOCUMENTS

| | | | |
|---|---|---|---|
| EP | 0 992 363 | A1 | 4/2000 |
| EP | 0 993 965 | A2 | 4/2000 |
| EP | 0 995 613 | A2 | 4/2000 |
| EP | 1 231 073 | A1 | 8/2002 |
| JP | 5-221137 | | 8/1993 |
| JP | 6-344662 | A | 12/1994 |
| JP | 9-254544 | A | 9/1997 |
| JP | 9-254547 | A | 9/1997 |
| JP | 10-10675 | A | 1/1998 |
| JP | 11-5366 | | 1/1999 |
| JP | 11-38609 | A | 2/1999 |
| JP | 11-58970 | | 3/1999 |
| JP | 11-70736 | | 3/1999 |
| JP | 11-147370 | | 6/1999 |
| JP | 11-254832 | A | 9/1999 |
| JP | 11-286174 | A | 10/1999 |
| JP | 2000-280600 | | 10/2000 |
| JP | 2000-289337 | | 10/2000 |
| JP | 2001-63214 | | 3/2001 |
| JP | 2002-29155 | | 1/2002 |

*Primary Examiner*—B. Hamilton Hess
(74) *Attorney, Agent, or Firm*—Sughrue Mion, PLLC

(57) ABSTRACT

A recording material comprising: a support; and (A) a recording layer capable of forming color due to application of at least one of heat and pressure thereto; and between the support and the recording layer, (i) a layer containing acetoacetyl denatured polyvinyl alcohol, partially saponified polyvinyl alcohol, and a film hardening agent, (ii) a layer containing acetoacetyl denatured polyvinyl alcohol and a film hardening agent, and (iii) a layer containing acetoacetyl denatured polyvinyl alcohol whose degree of polymerization is 1000 or more, or (B) between the support and the recording layer, at least one layer containing acetoacetyl denatured polyvinyl alcohol, partially saponified polyvinyl alcohol, and a film hardening agent, wherein the layer is coated with a coating solution whose viscosity is no more than 0.3 Pa·s at 40° C. by using a gravure roller.

22 Claims, No Drawings

RECORDING MATERIAL

BACKGROUND OF THE INVENTION

1. Field of the Invention

The present invention relates to a recording material, and in particular, to a recording material on which an image can be recorded by a thermal head or the like.

2. Description of the Related Art

Recording materials on which an image is recorded by heat being applied thereto by a thermal head or the like have come into wide use in recent years as the recording devices therefor are simple, reliable and do not require maintenance. Such recording materials include, on a support, a recording layer which contains, as color forming components, an electron donating dye precursor and an electron receiving compound, or a diazo compound and a coupler, for example. An image is recorded by utilizing a color forming reaction of the color-forming components which proceeds due to the application of heat.

In such a heat-sensitive type recording method, an image is recorded due to the application of heat. Thus, the surface temperature of the recording material becomes high during image recording. Further, if a contact type recording means such as a thermal head is used, pressure is applied to the recording material during the image recording. At this time, moisture and air in a recording layer expand due to the heat applied thereto, and then move to the surface of a coating layer of the support, and when the moisture and air reach the coating layer and continue to expand thereon, they form air gaps and cause a so-called blistering. The generation of blistering causes a deterioration of image quality such as glossiness, of a recorded image.

As a method of suppressing the generation of the blistering, a method is known in which a layer having low permeation with respect to gas water vapor, e.g., a so-called undercoat layer, is formed between the recording layer and the support. As the undercoat layer, a layer that contains a water-soluble resin such as polyvinyl alcohol, as a binder, is preferably used. Further, if the undercoat layer containing therein the polyvinyl alcohol is formed on a support, the coating layer is leveled to form a flat surface after being coated. Therefore, it is preferable to use a method in which, first, polyvinyl alcohol is dissolved in water, then methanol or the like is added to the mixed solution of the polyvinyl alcohol and the water, to thereby prepare a coating solution for undercoat layer.

However, even in a case of the undercoat layer containing the polyvinyl alcohol as described above, there is a possibility that cracks will be produced due to physical stress, and gas water vapor will reach the support via the cracks, whereby blistering might occur.

As described above, the recording material comprises a recording layer on a support. However, when the recording material is immersed in water, the recording from the support might peel off. It is desired to provide a recording material in which water resistance and wet bond strength are improved.

The coating solution for undercoat layer has high viscosity, and at the time of forming the undercoat layer, there has been a problem regarding coating suitability when the coating solution is coated using a gravure coating method which has been considered to be preferable from the viewpoint of cost. Further, there are some cases in which, after images were printed in an atmosphere of low humidity (for example, 10% at 20° C.), fine cracks were produced on the surface of the undercoat layer.

SUMMARY OF THE INVENTION

In order to solve the aforementioned problems, an object of the present invention is to provide a recording material in which the generation of blistering during image recording can be suppressed inexpensively, cracks are prevented from being produced in an atmosphere of low humidity, which enables formation of flat surface at imaging portions and has high water resistance, whereby images with high quality and excellent glossiness can be formed.

That is, the main object of the present invention is to provide a recording material which comprises a support, at least one recording layer which is disposed on the support and forms a color when at least one of heat and pressure is applied thereto, and at least one layer which comprises acetoacetyl denatured polyvinyl alcohol and disposed between the support and the recording layer.

The recording material according to a first aspect of the present invention is a recording material comprising a support, having disposed thereon at least one recording layer which forms a color when at least one of heat and pressure is applied thereto. The recording material further comprises at least one layer comprising the acetoacetyl denatured polyvinyl alcohol, a partially saponified polyvinyl alcohol and a film hardening agent. The at least one layer is disposed between the support and the recording layer. It is preferable that the at least one layer is formed as a so-called undercoat layer on the support adjacent thereto. Hereinafter, the layer containing therein acetoacetyl denatured polyvinyl alcohol, partially saponified polyvinyl alcohol, and a film hardening agent is sometimes referred to as an undercoat layer (1).

The recording material according to a second aspect of the present invention is a recording material comprising a support, having disposed thereon at least one recording layer which forms a color when at least one of heat and pressure is applied thereto. The recording material further comprises at least one layer comprising acetoacetyl denatured polyvinyl alcohol and a film hardening agent. The at least one layer is disposed between the support and the recording layer. It is preferable that the at least one layer is formed as a so-called undercoat layer on the support adjacent thereto. Hereinafter, the layer containing therein acetoacetyl denatured polyvinyl alcohol and a film hardening agent is sometimes referred to as an undercoat layer (2).

The recording material according to a third aspect of the present invention is at least one recording material comprising a support, having disposed thereon a recording layer which forms a color when at least one of heat and pressure is applied thereto. The recording material further comprises at least one layer comprising acetoacetyl denatured polyvinyl alcohol, partially saponified polyvinyl alcohol and a film hardening agent. The at least one layer is disposed between the support and the recording layer, and is formed by coating, with a gravure roller, a coating solution having a viscosity of no more than 0.3 Pa·s at 40° C. It is preferable that the at least one layer is formed as a so-called undercoat layer on the support adjacent thereto. Hereinafter, the layer containing therein acetoacetyl denatured polyvinyl alcohol, partially saponified polyvinyl alcohol and a film hardening agent is sometimes referred to as an undercoat layer (3).

The recording material according to a fourth aspect of the present invention is at least one recording material comprising a support, having disposed thereon a recording layer which forms a color when at least one of heat and pressure is applied thereto. The recording material further comprises at least one layer comprising acetoacetyl denatured polyvinyl alcohol disposed between the support and the recording layer, and said at least one layer having a degree of polymerization of at least 1000. Hereinafter, the layer containing therein acetoacetyl denatured polyvinyl alcohol is sometimes referred to as an undercoat layer (4).

DESCRIPTION OF THE PREFERRED EMBODIMENTS

Hereinafter, the recording material according to the first to fourth aspects of the present invention will be described in detail. It is also preferable to use the first to fourth aspects of the present invention in combination.

In accordance with the first to fourth aspects of the present invention, due to the undercoat layers (1) to (4), oxygen permeation can be suppressed to prevent the ground surfaces of the layers from being colored, and blistering can be prevented. The undercoat layers (1) to (3) are excellent in water resistance, whereby peeling-off of a recording layer from a support can be suppressed. The undercoat layer (4) is excellent since cracks are prevented from being produced in an atmosphere of low humidity.

Components that are contained in the undercoat layers will be explained in more detail.

[Acetoacetyl Denatured Polyvinyl Alcohol]

Acetoacetyl denatured polyvinyl alcohol contained in an undercoat layer (hereinafter, "acetoacetyl denatured PVA") provides a high oxygen permeation suppression rate and high S—S characteristics. Here, the S—S characteristics refer to an amount in which a tensional energy is absorbed (i.e., toughness) which is expressed by Stress—Strain until a coated film is broken. Therefore, an undercoat layer provides an oxygen permeation suppressing effect, and is able to freely expand/contract even when it is heated by a thermal head, whereby cracks are not produced and blistering does not occur.

The denature ratio of the acetoacetyl denatured PVA is preferably 0.05 to 20 mol %, and more preferably 0.05 to 15 mol %.

Since different values of the degree of polymerization of the PVA indicate different characteristics, it is preferable to select the degree of polymerization for each purpose.

In a case of the recording material according to the first to third aspects of the present invention, from a viewpoint of the improvement of coatability, a degree of polymerization of acetoacetyl denatured PVA is preferably 1000 or less, and more preferably 800 or less. If the degree of polymerization is 1000 or less, the coating solution has appropriate viscosity at which an undercoat layer is coated with the coating solution, whereby a good flat surface can be formed. Alternatively, from a viewpoint of adherence, the minimum degree of polymerization is preferably 100.

However, in a case of the recording material according to the fourth aspect of the present invention, from a viewpoint of preventing cracks from being produced, a degree of polymerization of the acetoacetyl denatured PVA is 1000 or more. By preparing the acetoacetyl denatured PVA so as to have a degree of polymerization of 1000 or more, cracks can be prevented from being produced in an atmosphere of low humidity (e.g., 10% at 20° C.). It can be thought that this is due to a relatively large value such as 1000 or more being set as a degree of polymerization that allows strength and strain at the time of breakage of the coated film to increase remarkably. Further, if the degree of polymerization of the PVA is increased, the viscosity of a coating solution increases, thereby deteriorating the coated surface state. However, this defect can be corrected by decreasing the concentration of the coating solution and a ratio of a water-dispersible mica dispersed in the solution to the PVA. The lower the ratio of the mica to the PVA, the higher the oxygen permeation. However, this defect can be corrected by increasing the degree of polymerization of the acetoacetyl denatured PVA.

The degree of polymerization of the acetoacetyl denatured PVA is preferably 1000 or more, and more preferably 1500 or more.

The degree of saponification of the acetoacetyl denatured PVA of the fourth aspect is not particularly limited, but is preferably 80 to 99.5%. If the degree of saponification of the PVA decreases, strain at the time of breakage of the coated film increases. Further, if the degree of polymerization of the PVA is high, the degree of saponification becomes high. However, if the degree of polymerization is low, it is preferable to lower the degree of saponification. Moreover, when the decrease of the degree of saponification has advantages of increasing the strain of the coated film, increasing the solubility of the PVA in methanol, decreasing the viscosity, improving a flat surface by leveling the coated surface, and thereby improving the coated surface state.

[Partially Saponified Polyvinyl Alcohol]

Partially saponified polyvinyl alcohol (hereinafter, "partially saponified PVA" lowers the viscosity of the coating solution for undercoat layer used for forming the undercoat layer. Namely, since the partially saponified PVA is highly soluble in alcohol, and easily dissolved in the solvent of the coating solution for undercoat layer, the viscosity of the coating solution for undercoat layer decreases. Then, when the coating solution is coated by using the gravure coating method, the decrease of the viscosity of the coating solution for undercoat layer improves the coated surface state. Since the temperature of vaporization heat is lower than that of water, the partially saponified PVA can be dried easily to thereby improve productive efficiency.

In accordance with the first aspect of the present invention, it is preferable that the degree of polymerization of acetoacetyl denatured PVA has a suitable value, the degree of saponification of partially saponified PVA is 30 to 90%, preferably 70 to 90% and more preferably 70 to 85%, and the degree of polymerization of the partially saponified PVA is 1000 or less. As described above, if the degree of polymerization of acetoacetyl denatured PVA is within the aforementioned range, when the coating solution for undercoat layer is coated, the viscosity thereof is appropriate, whereby excellent flatness can be formed on the coated surface. Further, from a viewpoint of adherence, the minimum degree of polymerization is preferably 100. Moreover, if the degree of saponification of the partially saponified PVA is within a range of 70 to 90%, the PVA has higher solubility in water and alcohol, such that the coating solution for undercoat layer can suitably be prepared.

In the third aspect of the present invention, when the degree of saponification of partially saponified PVA is 90% or less, the partially saponified PVA has excellent solubility in water and in the mixed solvent of water and methanol, whereby aggregates are not produced. Therefore, in the third aspect of the present invention, the degree of saponification of the partially saponified PVA is preferably no more than 90%, and more preferably no more than 85%, and the minimum thereof is preferably 30%.

In the present invention, a ratio (a/b) of the acetoacetyl denatured polyvinyl alcohol (a) to the partially saponified polyvinyl alcohol (b) is preferably from 0.5/0.5 to 0.9/0.1, and more preferably from 0.7/0.3 to 0.9/0.1. By setting the ratio (a/b) to 0.5/0.5 to 0.9/0.1, when the acetoacetyl denatured polyvinyl alcohol (a) and the partially saponified polyvinyl alcohol (b) are used in combination with a film hardening agent which will be described later, water resistance of the recording layer can be improved.

[Film Hardening Agent]

A film hardening agent and the acetoacetyl denatured PVA are reacted to each other, whereby water resistance of the recording layer can be improved. Accordingly, the peeling-off of the recording layer from the support can be suppressed. Examples of the film hardening agents include: diol compounds, epoxy compounds, blocked isocyanate, vinyl sulfone compounds, aldehyde compounds, methylol compounds, boric acid, carboxylic acid anhydride, silane compounds, chelate compounds, and halogenated compounds. Among these, it is preferable to use the diol compounds. Examples of the diol compounds include: ketene dimer, a dimethylol urea, 1-methyl-1,4-dioxane-2,3-diol, 1,4-dioxane-2,3-diol, ethyleneglycol, cyclohexanediol, and diethylene glycol.

The amount of the film hardening agent with respect to the amount of total solids of the undercoat layer is preferably from 0.5 to 20 mass % and more preferably from 1 to 10 mass %.

[Laminar Inorganic Compound]

The undercoat layer relating to the present invention preferably contains a laminar inorganic compound. The laminar inorganic compound is preferably a swellable inorganic laminar compound. Examples of such compounds include swellable clay minerals such as bentonite, hectorite, saponite, bidelite, nontronite, stevensite, beidellite, montmorillonite, swellable synthetic mica, and swellable synthetic smectite. These swellable inorganic laminar compounds have a laminated structure formed from a unit crystal lattice layer of a thickness of 10 to 15 Angstroms, and metal atom substitution in the lattice is markedly greater than other clay minerals. As a result, a shortage of positive charges arises in the lattice layer, and in order to compensate therefor, cations such as $Na^+$, $Ca^{2+}$, $Mg^{2+}$ and the like are adsorbed between the layers. The cations existing between the layers are called exchangeable cations, and can be exchanged with various cations. In particular, when the cations between the layers are $Li^+$, $Na^+$ or the like, because the ion diameter is small, the bond between the laminar crystal lattices is weak, and the laminar inorganic compound swells greatly due to water. In this state, when shearing is applied, the bond cleaves easily, and a sol which is stable in water is formed. This trend is strong in bentonite and swellable synthetic mica, and thus, bentonite and swellable synthetic mica are preferable to achieve the objects of the present invention. In particular, water swellable synthetic mica is preferable.

Examples of water swellable synthetic mica include Na tetrasic mica $NaMg_{2.5}(Si_4O_{10})F_2Na$, Li taeniolite (NaLi) $Mg_2(Si_4O_{10})F_2Na$, Li hectorite (NaLi)/$3Mg_2/3Li_{1/3}(Si_4O_{10})F_2$, and the like.

As for the size of the water swellable synthetic mica, the thickness is preferably 1 to 50 nm, and the surface size is preferably 1 to 20 μm. From the standpoint of control of diffusion, a smaller thickness is preferable. The larger the plane face size the more preferable, provided that the plane face size is within a range so as not to deteriorate the flatness and transparency of the coated surface.

Accordingly, the aspect ratio of the water swellable synthetic mica is preferably 100 or more, and more preferably 200 or more, and most preferably 500 or more.

[Mass Ratio of PVA and Water Swellable Synthetic Mica]

The mass ratio (x/y) of the acetoacetyl denatured PVA (x) and the water swellable synthetic mica (y) contained in the undercoat layer is 1 to 30, preferably in a range of 2 to 10, and more preferably in a range of 5 to 10. If the mass ratio is in a range of 2 to 10, the oxygen permeation suppression and the blistering generation suppression are effective.

The coated amount of the acetoacetyl denatured PVA in the undercoat layer is preferably 0.5 $g/m^2$ or more, and more preferably 0.8 $g/m^2$ or more. If the coated amount is 0.5 $g/m^2$ or more, sufficient oxygen permeation suppressing effect is shown. A maximum coated amount of the acetoacetyl denatured PVA is preferably 2.0 $g/m^2$ or less, and more preferably 1.5 $g/m^2$ or less. If the coated amount is 2.0 $g/m^2$ or less, sensitivity and $D_{max}$ of the recording material can be sufficiently ensured. The coated amount of the water swellable synthetic mica is preferably 0.05 $g/m^2$ or more to suppress the oxygen permeation, and is preferably derived from the aforementioned coated amount of the acetoacetyl denatured PVA and aforementioned mass ratio of the acetoacetyl denatured PVA.

However, in order for preventing a generation of cracks, in a case of the recording material according to the fourth aspect of the present invention, the mass ratio (x/y) of the acetoacetyl denatured PVA (x) contained in the undercoat layer and the water swellable synthetic mica (y) is preferably in a range of 1 to 30, and more preferably in a range of 2 to 20. If the mass ratio is in a range of 1 to 30, the oxygen permeation suppression and the blistering generation suppressing are effective. Further, the coated amount of the acetoacetyl denatured PVA is preferably in a range of 0.05 $g/m^2$ to 1.5 $g/m^2$ and more preferably in a range of 0.3 to 1.5 $g/m^2$. If the coated amount is 0.05 $g/m^2$ or more, the gas permeation suppression effect can be shown. If the coated amount is 2.0 $g/m^2$ or less, the gas permeation suppressing effect becomes sufficient, sensitivity and $D_{max}$ of the recording material can be sufficiently ensured.

The coated amount of the water swellable synthetic mica according to the fourth aspect of the present invention is preferably in a range of 0.02 g/m$^2$ to 0.5 g/m$^2$, and more preferably in a range of 0.05 g/m$^2$ to 0.4 g/m$^2$ to suppress the oxygen permeation, and is preferably derived from the aforementioned coated amount of the acetoacetyl denatured PVA and aforementioned mass ratio of the acetoacetyl denatured PVA.

In accordance with first to the fourth aspect of the present invention, the film thickness of the coated layer is preferably 0.5 μm to 2.5 μm, and more preferably 0.5 μm to 2.0 μm. If the film thickness is between 0.5 μm and 2.5 μm, the gas permeation suppressing effect and $D_{max}$ are sufficient, and the uniformity of the coated film can be secured. Accordingly, an image with high quality can be obtained.

[Support]

Examples of supports used in the recording material include various supports such as paper supports like base paper and synthetic paper, and plastic film supports. The base paper used as the paper support may contain, as the main material thereof, a natural pulp selected from coniferous trees, broad-leaved trees, or the like, and may contain other components. Examples of other components include fillers, sizing agents, softening agents, paper reinforcers, and fixing agents. Further, softening agents such as surfactants can be added. Examples of the filler include clay, talc, calcium carbonate, and urea resin particulates. Examples of the sizing agent include rosin, paraffin wax, higher fatty acid salts, alkenyl succinic acid salt, fatty acid anhydrides, styrene maleic anhydride copolymer, alkyl ketene dimer, and epoxidated fatty acid amides. Examples of the softening agent include reaction products of maleic anhydride copolymer and polyalkylene polyamine, and quaternary ammonium salts of higher fatty acids. Examples of the paper reinforcer include polyacrylamide, starch, polyvinyl alcohol, melamine formaldehyde condensation product, and gelatin. Examples of the fixing agent include aluminum sulfate, cationic polymer, and polyamide polyamine epichlorohydrine. As the paper support, a synthetic paper using a synthetic pulp in place of natural pulp may be used. Or a synthetic paper in which natural pulp and synthetic pulp are mixed together in an arbitrary ratio may be used. Among these, it is preferable to use coniferous tree pulp which is formed from short fibers and has a greater flatness. The hydrature of the pulp material which is used is preferably 200 to 500 cc (C.S.F.), and more preferably 300 to 400 cc.

The base paper may contain other components. Examples of other components include sizing agents, softening agents, paper reinforcers, and fixing agents. Examples of the sizing agent include rosin, paraffin wax, higher fatty acid salts, alkenyl succinic acid salt, fatty acid anhydrides, styrene maleic anhydride copolymer, alkyl ketene dimer, and epoxidated fatty acid amides. Examples of the softening agent include reaction products of maleic anhydride copolymer and polyalkylene polyamine, and quaternary ammonium salts of higher fatty acids. Examples of the paper reinforcer include polyacrylamide, starch, polyvinyl alcohol, melamine formaldehyde condensation product, and gelatin. Examples of the fixing agent include aluminum sulfate, cationic polymer, and polyamide polyamine epichlorohydrine. In addition, dyes, fluorescent dyes, antistatic agents and the like may be added if needed.

The support of the recording material of the present invention is preferably a support formed by both sides of a base paper being covered by polyolefin layers. When a support in which both sides of a base paper are covered by polyolefin layers is used, the surface flatness of the support improves, and differences in the thickness at image portions (so-called blistering), which differences are caused by the image density, can be reduced even more, and such a structure is therefore preferable.

The polyolefin layer can be formed at each surface of the base paper by laminating processing. The laminating processing can be appropriately selected from known methods such as those disclosed in "New Laminating Handbook" ("Shin Ramineto Kakou Binran") edited by the Processing Technology Research Association (Kakou Gijutsu Kenkyuukai). Methods such as so-called dry lamination, solvent-less-type dry lamination, hot melt lamination and the like can be used. For example, in a case in which the polyolefin layer is formed by dry lamination, the layer can be formed by coating an adhesive on one surface of a polyolefin resin film, drying as desired, and thermally pressure-adhering the film to the surface of a base paper. Examples of the adhesive include solvent-type vinyl resins, acrylic resins, polyamide resins, epoxy resins, rubber type resins, and urethane resins. Further, the front surface and/or the reverse surface of the base paper may be subjected to a corona discharge treatment so as to improve the adhesion with the polyolefin layer.

[Recording Layer]

The recording layer comprises a layer which can form color due to the application of heat and/or pressure thereto.

In the case of a recording material for multi-color image formation, the recording material may have two or more recording layers which can form colors of respectively different hues due to application of heat and/or pressure.

Generally, in a recording material for multiple colors, in order to provide an uneven difference in the energies applied to the respective recording layers such that desired colors are formed, blistering is remarkable during image printing at a high printing energy. However, in the recording material of the present invention, the generation of blisters is suppressed by the gas permeation suppression due to the under layer of the present invention, and high image quality of multi-color images can be maintained.

The recording material for multiple colors may be a recording material which can form a full color image by comprising recording layers which form colors of, for example, cyan, magenta, and yellow, being layered. The structural examples of recording materials for multiple colors and the recording methods disclosed in Japanese Patent Application Laid-Open (JP-A) No. 11-34495, columns 36–38 may be applied to the recording material of the present invention.

The color forming layer of the present invention preferably comprises components which are colorless at normal temperature and normal pressure, and which form color due to the application of heat and/or pressure thereto. Suitable examples of these color forming components include the following combinations (i) through (xviii).

(i) a combination of an electron donating dye precursor and an electron receiving compound;
(ii) a combination of a diazo compound and a coupling component (hereinafter referred to as "coupler" when appropriate);
(iii) a combination of an organic acid metal salt such as silver behenate, silver stearate or the like, and a reducing agent such as protocatechuic acid, spiroindane, hydroquinone or the like;
(iv) a combination of a long-chain fatty acid iron salt such as ferric stearate, ferric myristinate or the like, and a phenol such as tannic acid, gallic acid, ammonium salicylate or the like;
(v) a combination of an organic heavy metal salt such as a nickel, cobalt, lead, copper, iron, mercury, or silver salt of acetic acid, stearic acid, or palmitic acid and an alkali metal or an alkali earth metal sulfide such as calcium sulfide, strontium sulfide, potassium sulfide or the like; or a combination of such an organic heavy metal salt and an organic chelating agent such as s-diphenylcarbazide, diphenylcarbazone or the like;
(vi) a combination of a heavy metal sulfate such as a sulfate of silver, lead, mercury, sodium or the like, and a sulfur compound such as sodium tetrathionate, sodium thiosulfate, thiourea or the like;
(vii) a combination of an aliphatic ferric salt such as ferric stearate or the like, and an aromatic polyhydroxy compound such as 3,4-hydroxytetraphenylmethane or the like;
(viii) a combination of a metal salt of an organic acid such as silver oxalate, mercury oxalate or the like, and an organic polyhydroxy compound such as polyhydroxy alcohol, glycerin, glycol or the like;
(ix) a combination of a fatty acid ferric salt such as ferric pelargonate, ferric laurate or the like, and a thiocetylcarbamide or isothiocetylcarbamide derivative;
(x) a combination of an organic acid lead salt such as lead capronate, lead pelargonate, lead behenate or the like, and a thiourea derivative such as ethylene thiourea, N-dodecyl thiourea or the like;
(xi) a combination of a higher aliphatic heavy metal salt such as ferric stearate, copper stearate or the like, and zinc dialkyldithiocarbamate;
(xii) a combination which forms an oxazine dye such as a combination of resorcin and a nitroso compound;
(xiii) a combination of a formazan compound and a reducing agent and/or a metal salt;
(xiv) a combination of a protected dye (or leuco dye) precursor and a deprotecting agent;
(xv) a combination of an oxidation type color forming agent and an oxidizing agent;
(xvi) a combination of phthalonitriles and diiminoisoindolines (a combination by which phthalocyanine is generated);
(xvii) a combination of isocyanates and diiminoisoindolines (a combination by which a colored pigment is generated); and
(xviii) a combination of a pigment precursor and an acid or a base (a combination by which a pigment is formed).

Among these, in the present invention, (i) a combination of an electron donating dye precursor and an electron receiving compound and (ii) a combination of a diazo compound and a coupler are preferable.

-Electron Donating Dye Precursor-

Examples of the electron donating dye precursor used in above combination (i) include compounds such as phthalide compounds, fluoran compounds, phenothiazine compounds, indolylphthalide compounds, leucoauramine compounds, rhodamine lactam compounds, triphenylmethane compounds, triazene compounds, spiropyran compounds, pyridine compounds, pyrazine compounds, fluorene compounds, and the like.

Examples of phthalide compounds include the compounds disclosed in U.S. Reissue Pat. No. 23,024 and U.S. Pat. Nos. 3,491,111, 3,491,112, 3,491,116, and 3,509,174. Specific examples include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindol-3-yl) phthalide, 3-(p-dimethylaminophenyl)-3-(2-methylindol-3-yl)phthalide, and the like.

Examples of fluoran compounds include the compounds disclosed in U.S. Pat. Nos. 3,624,107, 3,627,787, 3,641,011, 3,462,828, 3,681,390, 3,920,510, and 3,959,571. Specific examples thereof include 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, 2-(3,4,-dichloroanilino)-6-diethylaminofluoran, and the like.

Examples of phenothiazine compounds include benzoyl leucomethylene blue, p-nitrobenzyl leucomethylene blue, and the like.

Examples of leucoauramine compounds include 4,4'-bis-dimethylaminobenzohydrinebenzylether, N-halophenyl-leucoauramine, N-2,4,5-trichlorophenylleucoauramine, and the like.

Examples of the rhodamine lactam compound include rhodamine-B-anilinolactam, rhodamine-(p-nitroanilino) lactam, and the like.

Examples of the spiropyran compounds include the compounds disclosed in U.S. Pat. No. 3,971,808. Specific examples include 3-methyl-spiro-dinaphthopyrane, 3-ethyl-spiro-dinaphthopyrane 3,3'-dichloro-spiro-dinaphthopyrane, 3-benzylspiro-dinaphthopyrane, 3-methyl-naphtho-(3-methoxy-benzo)spiropyran, 3-propyl-spiro-dibenzopyrane, and the like.

Examples of the pyridine and pyrazine compounds include the compounds disclosed in U.S. Pat. Nos. 3,775,424, 3,853,869, and 4,246,318.

Examples of fluorene compounds include the compounds disclosed in Japanese Patent Application Laid-Open No. 63-94878.

The dye precursors disclosed in U.S. Pat. No. 4,800,149 can be used as the dye precursors which form cyan, magenta, and yellow. Further, the dye precursors disclosed in U.S. Pat. No. 4,800,148 can be used as the electron donating dye precursor for the yellow color forming dye. The dye precursors disclosed in JP-A No. 63-53542 can be used as the electron donating dye precursor for the cyan color forming dye.

-Electron Receiving Compound-

Examples of the electron receiving compound used in combination (i) include conventionally known electron receiving compounds such as phenol derivatives, salicylic acid derivatives, metal salts of aromatic carboxylic acid, acid clay, bentonite, novolak resin, metal treated novolak resin, metal complexes, and the like. Specific examples are disclosed in JP-B Nos. 40-9309 and 45-14039, and JP-A Nos. 52-140483, 48-51510, 57-210886, 58-87089, 59-11286, 60-176795, 61-95988, and the like.

Examples of phenol derivatives include 2,2'-bis(4-hydroxyphenyl)propane, 4-t-butylphenol, 4-phenylphenol, 4-hydroxydiphenoxide, 1,1'-bis(3-chloro-4-hydroxyphenyl) cyclohexane, 1,1'-bis(4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcychohexylidenephenol, 4,4'-isopentylidenephenol, benzyl p-hydroxybenzoate, and the like.

Examples of salicylic acid derivatives include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and the like, and zinc, aluminum, calcium, copper, and lead salts thereof, and the like.

When combination (i) (electron donating dye precursor and electron receiving compound) is used as the color forming component, the contained amount of the electron donating dye precursor in the recording layer is preferably 0.1 to 5 g/m$^2$, and more preferably 0.1 to 1 g/m$^2$.

The contained amount of the electron receiving compound is preferably 0.5 to 20 parts by mass, and more preferably 3 to 10 parts by mass, with respect to 1 part by mass of the electron donating colorless dye. When the contained amount is less than 0.5 parts by mass, sufficient formed color density cannot be obtained, and when the contained amount exceeds 20 parts by mass, the sensitivity may decrease and the suitability for coating may deteriorate.

-Diazo compound-

Compounds expressed by the following formula are preferable as the diazo compound used in above combination (ii):

$$Ar\text{-}N_2^+.Y^-$$

wherein Ar represents an aromatic ring group, and $Y^-$ represents an acid anion.

In the above formula, Ar represents a substituted or unsubstituted aryl group. Examples of the substituent include an alkyl group, alkoxy group, alkylthio group, aryl group, aryloxy group, arylthio group, acyl group, alkoxycarbonyl group, carbamoyl group, carboamide group, sulfonyl group, sulfamoyl group, sulfonamide group, ureido group, halogen group, amino group, heterocyclic group, and the like. These substituents may be substituted.

As the aryl group, aryl groups having from 6 to 30 carbon atoms are preferable, and examples thereof include a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy)phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3,5-dichlorophenyl group, 3,4-dimethoxyphenyl group, 3-(dibutylaminocarbonylmethoxy) phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonylphenyl group, 4-ethoxycarbonylphenyl group, 4-(2-ethylhexylcarbonyl) phenyl group, 4-fluorophenyl group, 3-acetylphenyl group, 2-acetylaminophenyl group, 4-(4-chlorophenylthio) phenyl group, 4-(4-methylphenyl) thio-2,5-butoxyphenyl group, 4-(N-benzyl-N-methylamino)-2-dodecyloxycarbonylphenyl group, and the like.

These groups may be substituted by an alkyloxy group, alkylthio group, substituted phenyl group, cyano group, substituted amino group, halogen atom, heterocyclic group, and the like.

Specific examples of the diazo compound which can suitably be used as a color forming component are the diazo compounds disclosed in JP-A No. 7-276808, paragraphs 44 through 49.

The maximum absorption wavelength $\lambda_{max}$ of the diazo compound is preferably 450 nm or less, and is more preferably 290 to 440 nm. Further, it is preferable that the number of carbon atoms of the diazo compound is 12 or more, the solubility in water is 1% or less, and the solubility in ethyl acetate is 5% or more.

In the present invention, a single diazo compound may be used, or two or more diazo compounds can be used in accordance with an object such as adjustment of the hue or the like.

-Coupler-

The coupler used in above combination (ii) is a coupler which couples with a diazo compound, which is used in combination in a basic atmosphere and/or a neutral atmosphere, so as to form a dye. Multiple types of couplers may be used together in accordance with the various objects such as adjustment of the hue or the like.

Couplers such as so-called active methylene compounds having a methylene group next to a carbonyl group, phenol derivatives, naphthol derivatives, and the like are preferably used as the coupler. Specific examples include resorcin, phloroglucin, 2,3-dihydroxynaphthalene, sodium 2,3-dihydroxynaphthalene-6-sulfonate, 1-hydroxy-2-naphthoic acid morpholinopropylamide, sodium 2-hydroxy-3-naphthalene sulfonate, 2-hydroxy-3-naphthalenesulfonic acid anilide, 2-hydroxy-3-naphthalenesulfonic acid morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis-(benzoylacetamide)toluene, 1,3-bis-(pivaloylacetamidemethyl)benzene, benzoylacetonitrile, thenoylacetonitrile, acetoacetanilide, benzoylacetanilide, pivaloylacetanilide, 2-chloro-5-(N-n-butylsulfamoyl)-1-pivaloylacetamidebenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, and 1-(4-n-octyloxyphenyl)-3-tert-butyl-5-aminopyrazole, and the like.

For details of the above couplers, refer to JP-A Nos. 4-201483, 7-223367, 7-223368, 7-323660, 5-278608, 5-297024, 6-18669, 6-18670, 7-316280, 9-216468, 9-216469, 9-319025, 10-03513, 10-193801, 10-264532, and the like.

When combination (ii) (a diazo compound and a coupler) is used as the color forming components, the contained amount of the diazo compound in the recording layer is preferably 0.02 to 5.0 g/m$^2$, and more preferably 0.05 to 3.0 g/m$^2$. If the contained amount is less than 0.02 g/m$^2$, it may not be possible to obtain a sufficient formed color density. If the contained amount exceeds 5.0 g/m$^2$, the coating suitability of the coating solution may deteriorate.

The amount of the coupler is preferably 0.5 to 20 parts by mass, and more preferably 1 to 10 parts by mass, with respect to 1 part by mass of the diazo compound. When the contained amount is less than 0.5 parts by mass, it may not be possible to obtain a sufficient formed color density, and when the amount exceeds 20 parts by mass, the suitability for coating may deteriorate.

The above coupler (together with other components which are added if desired) may be used by adding a water soluble polymer and dispersing the solids by a sand mill or the like. Or the coupler can be emulsified together with an appropriate emulsification aid, and used as an emulsion. The methods of dispersing the solids and emulsifying are not particularly limited, and conventionally known methods can be used. Details of these methods are disclosed in JP-A Nos. 59-190886, 2-141279, and 7-17145.

-Organic Base-

From the standpoint of promoting the coupling reaction between the diazo compound and the coupler, it is preferable to use an organic base such as tertiary amines, piperidines, piperazines, amidines, formamidines, pyridines, guanidines, morpholines, or the like.

Examples of the organic base include piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, 1,4-bis[[3-(N-methylpiperazino)-2-hydroxy]propyloxy]benzene, and the like; morpholines such as N-[3-(β-naphthoxy)-2-hydroxy]propylmorpholine, 1,4-bis[(3-morpholino-2-hydroxy)propyloxy]benzene, 1,3-bis[(3-morpholino-2-hydroxy)propyloxy]benzene, and the like; piperidines such as N-(3-phenoxy-2-hydroxypropyl)piperidine, N-dodecylpiperidine, and the like; triphenylguanidine, tricyclohexylguanidine, dicyclohexylphenylguanidine, 4-hydroxy-benzoic acid-2-N-methyl-N-benzyl-aminoethylester, 4-hydroxy-benzoic acid-2-N,N-di-n-butyl-aminoethyl ester, 4-(3-N,N-dibutylaminopropoxy)benzenesulfonamide, 4-(2-N,N-dibutylaminoethoxycarbonyl)phenoxy acetamide, and the like.

A single one of these organic bases may be used, or two or more may be used in combination.

These organic bases are disclosed in JP-A Nos. 57-123086, 60-49991 and 60-94381, and Japanese Patent Application Nos. 7-228731, 7-235157 and 7-235158.

The amount of the organic base which is used is not particularly limited, but is preferably 1 to 30 mol with respect to 1 mol of the diazo compound.

-Color Forming Aid-

A color forming aid can be added for the purpose of promoting the color forming reaction.

Examples of the color forming aid are phenol derivatives, naphthol derivatives, alkoxy substituted benzenes, alkoxy substituted naphthalenes, hydroxy compounds, amide carboxylate compounds, sulfonamide compounds, and the like.

-Binder-

The recording layer may contain a binder as well as the color forming component. The binder is usually water soluble, and examples thereof include polyvinyl alcohol, hydroxyethyl cellulose, hydroxypropyl cellulose, ethylene-maleic anhydride copolymer, styrene-maleic anhydride copolymer, isobutylene-maleic anhydride copolymer, polyacrylic acid, starch derivatives, casein, gelatin, and the like. The amount of the binder is preferably 10 to 30% by mass (dried mass) in the recording layer. For the purpose of making the binder water-resistant, a water-resistant agent (a gelling agent and/or a crosslinking agent) may be added, or a hydrophobic polymer emulsion, specifically, a styrene-butadiene rubber latex, an acrylic resin emulsion or the like, may be added.

-Other Components-

An antifoaming agent, a fluorescent dye, a coloring dye, an inorganic pigment, a wax, a higher fatty acid amide, a metal soap, an ultraviolet absorbent, an antioxidant, a latex binder, and the like may be added to the recording layer as needed. Further, it is effective to include in the recording layer or in the other layers any of various types of additives which are used in heat-sensitive recording materials and pressure-sensitive recording materials.

Examples of such additives include the compounds disclosed in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, JP-B Nos. 48-043294, 48-033212, and the like.

-Microcapsules-

In order for the recording layer to form color when heat and/or pressure is applied thereto, it is preferable to impart a heat-responsive property and/or a pressure-responsive property to the color forming reaction of the color forming component. For example, by encapsulating one of the color forming components in heat-responsive and/or pressure-responsive microcapsules, the color forming reaction can be made to be heat-responsive and/or pressure-responsive.

Any of conventional, known methods can be used as the method for microencapsulating the color forming components. Examples include methods of utilizing coacervation of a hydrophilic wall-forming material disclosed in U.S. Pat. Nos. 2,800,457 and 2,800,458; the interfacial polymerization methods disclosed in U.S. Pat. No. 3,287,154, British Patent No. 990443, JP-B Nos. 38-19574, 42-446 and 42-771; the methods using polymer precipitation disclosed in U.S. Pat. Nos. 3,418,250 and 3,660,304; the method using an isocyanatepolyol wall material disclosed in U.S. Pat. No. 3,796,669; the method using an isocyanate wall material disclosed in U.S. Pat. No. 3,914,511; the methods using urea-formaldehyde and urea formaldehyde-resorcinol wall forming materials disclosed in U.S. Pat. Nos. 4,001,140, 4,087,376, and 4,089,802; the method using wall-forming materials of melamine-formaldehyde resin, hydroxypropyl cellulose, and the like disclosed in U.S. Pat. No. 4,025,455; the in situ methods using polymerization of monomers disclosed in JP-B No. 36-9168 and JP-A No. 51-9079; the electrolysis dispersing cooling methods disclosed in British Patent Nos. 952807 and 965074; the spray drying methods disclosed in U.S. Pat. No. 3,111,407 and British Patent No. 930422; and the like.

The method of microencapsulation preferably employs, for example, the following interfacial polymerization method. An oil phase is prepared by dissolving or dispersing, in a hydrophobic organic solvent which is to become the cores of the capsules, one color forming component (the electron donating dye precursor in the case of above combination (i), and the diazo compound in the case of above combination (ii)). This oil phase is mixed together with a water phase in which a water soluble polymer is dissolved. The mixture is emulsified by a means such as a homogenizer or the like. Thereafter, a polymer forming reaction is carried out at oil droplet interfaces by heating, such that a polymer substance microcapsule wall is formed. In accordance with this method, capsules of a uniform particle diameter can be formed within a short period of time, and can obtain a recording material having excellent raw stock storability.

A reactant which forms the polymer substance is added to the interior of the oil droplet and/or to the exterior of the oil droplet. Specific examples of the polymer substance include polyurethanes, polyureas, polyamides, polyesters, polycarbonates, urea-formaldehyde resins, melamine resins, polystyrenes, styrene-methacrylate copolymers, styrene-acrylate copolymers, and the like. Among these substances, polyurethanes, polyureas, polyamides, polyesters, and polycarbonates are preferable, and polyurethanes and polyureas are particularly preferable. Two or more of the polymer substances may be used in combination.

Examples of the water soluble polymers include gelatins, polyvinylpyrolidones, polyvinylalcohols, and the like. For example, in a case in which polyurethane is used as the capsule wall material, polyvalent isocyanate and a second substance (e.g., polyol or polyamine), which reacts with the polyvalent isocyanate and forms the capsule wall, are mixed together in a water soluble polymer aqueous solution (water phase) or an oily medium to be encapsulated (oil phase). The mixture is emulsified, and thereafter, by raising the temperature, a polymer-forming reaction takes place at the oil droplet interface such that the microcapsule wall is formed. The particle diameter of the microcapsules is preferably 0.1 to 1.0 μm, and more preferably 0.2 to 0.7 μm.

Examples of other methods for making the color forming reaction heat-responsive include a method of mixing heat fusible substances having a low melting point with one of the color forming components (e.g., the electron receiving compound in above combination (i), or the coupler in above combination (ii), hereinafter referred to upon occasion as the "developer"), and adding the mixture into the recording layer as a eutectic material; and a method of adding, to the recording layer, a low melting point compound which is in a state of being fused to the surface of developer particles. Waxes are examples of materials, which can be used for the low boiling point compound. Examples of waxes include paraffin wax, carnauba wax, microcrystalline wax, polyethylene wax, and the like. Other examples include higher fatty acid amides such as amide stearate and ethylene bis stearoamides, and higher fatty acid esters, and the like.

(Method of Forming Recording Layer)

The recording layer can be formed on the resin layer, by applying and drying a coating solution in which the color forming component, and if desired, other components to be added such as a binder or the like, are dissolved and/or dispersed in a solvent. Any of conventional, known coating methods, such as a blade coating method, an air knife coating method, a gravure coating method, a roll coating method, a spray coating method, a dip coating method, a bar coating method, an extrusion coating method, or the like, can be used as the method of coating the coating solution.

The coated amount of the coating solution forming the recording layer is not particularly limited, but usually a dried mass of 3 to 15 g/m$^2$ is preferable, and 4 to 10 g/m$^2$ is more preferable.

In the recording material of the present invention, if desired, an intermediate layer may be provided between two recording layers, and a protective layer and an ultraviolet light (light transmittance) adjusting layer may be provided on the recording layer. For the materials contained in the respective layers and arrangements of the respective layers, examples of materials and arrangements disclosed in columns 39 through 60 of JP-A No. 11-34495 can be applied to the recording material of the present invention.

EXAMPLES

In Examples of the present invention, "parts" represent "parts by mass" unless otherwise indicated. Examples according to the first to fourth aspects of the present invention will be described hereinafter.

Examples of the First Aspect of the Present Invention

Example 1

(1) Preparation of PVA Solution.

First, 10 parts of acetoacetyl denatured PVA (degree of saponification: 99%, degree of polymerization: about 300, trade name: Goacefimer Z-100 (GFZ100), manufactured by Japan Synthetic Chemical Industrial Co., Ltd.), 10 parts of partially saponified PVA (degree of saponification: 86.5 to 89.5%, degree of polymerization: 500, trade name: PVA205, manufactured by Kuraray Co., Ltd.), and 80 parts of water were added, and stirred and dissolved at 90° C. so as to form a PVA solution.

(2) Preparation of Mica Dispersed Solution:

Water swellable synthetic mica dispersed solution (aspect ratio: 1000, trade name: SOMASHIF MEB-3 (8% solution), manufactured by Co-op Chemical Co., Ltd., and a dispersed solution of mica whose average particle diameter is 2.0 μm) and water were mixed such that the concentration of mica became 5% by mass, and the solution was mixed uniformly to obtain a mica dispersed solution.

(3) Film Hardening Agent:

A diol compound (2,3-hydroxy-5methyl-1,4 dioxane) (50%) (4) 1.66 Mass % Solution of Ethylene Oxide Based Surfactant (Dissolved in Methanol).

Then, 18 parts water and 81 parts methanol were added to 100 parts of the above (1) 20 mass % PVA solution at 90° C., and the resultant solution was sufficiently stirred and mixed. Thereafter, 40 parts of the above (2) 5 mass % mica dispersed solution was added, the resultant mixture was sufficiently stirred and mixed, and 9.8 parts of the 1.66 mass % of the above (4) surfactant was added. Next, the liquid temperature was maintained at 35° C. to 40° C., and 1 part of the above (3) hardening agent was added, such that a coating solution (9.7%) for undercoat layer was obtained.

While the obtained coating solution for undercoat layer was adjusted by a gravure roller (#100 mesh, diagonal lines), such that the coated amount was 12.5 g/m$^2$, the coating solution was applied onto a support for a photographic printing paper wherein a polyester film was laminated on each side of high quality paper and a surface active treatment (corona discharge) was conducted, so as to form the undercoat layer. At this time, the mass ratio of the acetoacetyl denatured PVA to the water swellable synthetic mica was 5.

-Formation of Recording Layer- (Preparation of Coating solution A for Recording Layer)

-Preparation of Electron Donating Dye Precursor Capsule Liquid-

As the electron donating dye precursor, 3.0 parts of crystal violet lactone was dissolved in 20 parts of ethyl acetate. 20 parts of alkyl naphthalene, which is a high boiling solvent, was added thereto, and the resultant mixture was heated and mixed uniformly. As the capsule wall agent, 20 parts of a xylene diisocyanate/trimethylol propane addition product was added to this solution, and the resultant mixture was stirred uniformly, and an electron donating dye precursor solution was obtained. Separately, 54 parts of a 6% aqueous solution of gelatin was prepared, the previous electron donating dye precursor solution was added thereto, and the mixture was emulsified by a homogenizer. 68 parts water was added to the obtained emulsion liquid, and the mixture was made uniform. Thereafter, while stirring was carried out, the temperature was raised to 50° C., and an encapsulating reaction was carried out for 3 hours, such that an electron donating dye precursor capsule liquid was obtained. The average particle diameter of the capsules was 1.6 μm.

-Preparation of Electron Receiving Compound Dispersed Solution-

As the electron receiving compound, 30 parts of bisphenol A was added to 150 parts of a 4% aqueous solution of gelatin, and the resultant mixture was dispersed for 24 hours by a ball mill so as to prepare the electron receiving compound dispersed solution. The average particle diameter of the electron receiving compound in the dispersed solution was 1.2 μm.

-Preparation of Coating Solution-

The above electron donating dye precursor capsule liquid and electron receiving compound dispersed solution were mixed together such that the ratio of the electron donating dye precursor/electron receiving compound was 1/2, and the target coating solution A was prepared.

(Preparation of Coating Solution B for Recording Layer)

-Preparation of Diazonium Salt Compound Capsule Liquid b-

As the diazonium salt compound, 2.0 parts of 4-(N-2-(2,4-di-tert-amylphenoxy)butyryl) piperazinobenzenediazoniumhexafluorophosphate was dissolved in 20 parts of ethyl acetate. 20 parts of alkyl naphthalene, which is a high boiling point solvent, was added thereto, and the resultant mixture was heated and mixed uniformly. As the capsule wall agent, 15 parts of a xylylene diisocyanate/trimethylol propane addition product was added to this solution, and the resultant mixture was stirred uniformly to obtain a diazonium salt compound solution. Separately, 54 parts of a 6% by mass aqueous solution of gelatin was prepared, and was added to the diazonium salt compound solution, and the mixture was emulsified by a homogenizer. 68 parts water was added to the obtained emulsion liquid, and the mixture was made uniform. Thereafter, while stirring was carried out, the temperature was raised to 40° C., an encapsulating reaction was carried out for 3 hours, and a diazo compound capsule liquid b was obtained. The average particle diameter of the capsules was 1.1 μm.

-Preparation of Coupler Emulsion Liquid b-

As the coupler, 2 parts of 1-(2'-octylphenyl)-3-methyl-5-pyrazolone, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 parts of tricresylphosphate, 0.1 parts of diethyl maleate, and 1 part of a 70% calcium dodecylbenzenesulfonate methanol solution were dissolved in 10 parts of ethyl acetate. The solution was added to 80 parts of an 8% gelatin aqueous solution, and the mixture was emulsified for 10 minutes with a homogenizer. Thereafter, the ethyl acetate was removed to obtain coupler emulsion liquid b.

-Preparation of Coating Solution-

The above diazonium salt compound capsule liquid b and coupler emulsion liquid b were mixed together such that a ratio of the diazonium salt compound/coupler ratio was 2/3, and the object coating solution B was prepared.

(Preparation of Coating Solution C for Recording Layer)

-Preparation of Diazonium Salt Compound Capsule Liquid c-

As the diazonium salt compound, 3.0 parts of 2,5-dibutoxy-4-tolylthiobenzenediazoniumhexafluorophosphate was dissolved in 20 parts of ethyl acetate. 20 parts of alkyl naphthalene, which is a high boiling point solvent, was added thereto, and the resultant mixture was heated and mixed uniformly. As the capsule wall agent, 15 parts of a xylylene diisocyanate/trimethylol propane addition product was added to this solution, and the resultant mixture was stirred uniformly to obtain a diazonium compound solution. Separately, 54 parts of a 6% aqueous solution of gelatin was prepared, and was added to the diazonium compound solution, and the mixture was emulsified by a homogenizer. 68 parts water was added to the obtained emulsion liquid, and the mixture was made uniform. Thereafter, while stirring was carried out, the temperature was raised to 40° C., an encapsulating reaction was carried out for 3 hours, and a diazo compound capsule liquid c was obtained. The average particle diameter of the capsules was 1.0 μm.

-Preparation of Coupler Emulsion Liquid c-

As the coupler, 2 parts of 2-chloro-5-(3-(2,4-di-tert-pentyl)phenoxypropylamino)acetoacetanilide, 2 parts of 1,2,3-triphenylguanidine, 2 parts of 1,1-(p-hydroxyphenyl)-2-ethylhexane, 4 parts of 4,4'-(p-phenylenediisopropylidene) diphenol, 4 parts of 2-ethylhexyl-4-hydroxybenzoate, 0.3 parts of tricresylphosphate, 0.1 parts of diethyl maleate, and 1 part of a 70% calcium dodecylbenzenesulfonate methanol solution were dissolved in 10 parts ethyl acetate. This solution was added to 80 parts of an 8% gelatin aqueous solution, and the mixture was emulsified for 10 minutes by a homogenizer. Thereafter, the ethyl acetate was removed to obtain coupler emulsion liquid c.

-Preparation of Coating Solution-

The above diazo compound capsule liquid c and coupler emulsion liquid c were mixed together such that the ratio of diazo compound/coupler was 4/5, and the object coating solution C was prepared.

(Preparation of Coating Solution for Light Transmittance Adjusting Layer)

-Preparation of UV Absorbent Precursor Capsule Liquid-

As a UV absorbent precursor, 10 parts of [2-aryl-6-(2H-benzotriazole-2-yl)-4-t-octylphenyl]benzenesulfonate, 3 parts of 2,5-di-t-octyl-hydroquinone, 2 parts of tricresyl phosphate, and 4 parts of α-methyl styrene dimer were dissolved in 30 parts of ethyl acetate. As a capsule wall agent, 20 parts of a xylylene diisocyanate/trimethylol propane addition product was added to this solution, and the resultant solution was stirred uniformly such that a UV absorbent precursor solution was obtained.

Separately, 200 parts of an 8% itaconic acid denatured polyvinyl alcohol aqueous solution was prepared, and the above UV absorbent precursor solution was added thereto. The resultant mixture was emulsified in a homogenizer. 120 parts water was added to the obtained emulsion, and the solution was made uniform. Thereafter, while stirring was carried out, the temperature was raised to 40° C., and an encapsulating reaction was carried out for 3 hours so as to obtain a UV absorbent precursor encapsulating microcapsule liquid. The average particle diameter of the microcapsules was 0.3 μm.

-Preparation of Coating Solution- 10 parts of a 2% aqueous solution of sodium [4-nonylphenoxytrioxyethylene]butyl sulfonate was added to 100 parts of the above UV absorbent precursor encapsulating microcapsule liquid, and a coating solution for the light transmittance adjusting layer was obtained.

(Preparation of Coating Solution for Intermediate Layer)

2 parts of 2% sodium (4-nonylphenoxytrioxyethylene) butyl sulfonate was added to 100 parts of a 10% gelatin aqueous solution, so as to prepare a coating solution for intermediate layer.

(Preparation of Coating Solution for Protective Layer)

2.0 parts of a 20.5% zinc stearate dispersion liquid (HYDRINE F115, manufactured by Chukyo Yushi KK) were added to 61 parts of a 5.0% ethylene denatured polyvinyl alcohol aqueous solution. Further, 8.4 parts of a 2% aqueous solution of sodium (4-nonylphenoxytrioxyethylene)butyl sulfonate, 8.0 parts of a fluorine containing mold releasing agent (ME-313, manufactured by Daikin KK), and 0.5 parts of wheat flour starch were added thereto, and the mixture was stirred uniformly so as to prepare a PVA liquid.

Separately, 12.5 parts of a 20% aqueous solution of KAOGROS (manufactured by Shiraishi Kogyo KK), 1.25 parts of a 10% aqueous solution of polyvinyl alcohol (PVA105, manufactured by Kuraray Co., Ltd.), and 0.39 parts of a 2% aqueous solution of sodium dodecylsulfonate were mixed together, and dispersed by a dynomill so as to prepare a pigment liquid.

4.4 parts of the pigment liquid were added to 80 parts the liquid PVA, so as to prepare the coating solution for a protective layer.

(Formation of Recording Layer)

The coating solution A for recording layer, the coating solution for intermediate layer, the coating solution B for recording layer, the coating solution for intermediate layer, the coating solution C for recording layer, the coating solution for the light transmittance adjusting layer, and the coating solution for the protective layer were continuously coated at a coating speed of 60 m/min, in the order listed herein, on the resin layer of a support whose resin layer (undercoat layer) was formed as described above, such that seven layers were formed simultaneously. The structure was dried under conditions of 30° C. and 30% RH, and of 40° C. and 30% RH, so as to prepare the multicolor heat-sensitive recording material of the present invention. Here, the coated amounts of solids of the respective layers were 6.0 g/m$^2$ for the recording layer A, 3.0 g/m$^2$ for the intermediate layer, 6.0 g/m$^2$ for the recording layer B, 3.0 g/m$^2$ for the intermediate layer, 5.0 g/m$^2$ for the recording layer C, 3.0 g/m$^2$ for the transmittance adjusting layer, and 1.5 g/m$^2$ for the protective layer.

Example 2

A recording material was prepared in the same way as in Example 1, except that the ratio of the acetoacetyl denatured PVA to the partially saponified PVA was changed to 0.85/0.15, the amounts of the water and the methanol to be added to 100 parts of the PVA solution were changed to 25 parts and 110 parts, respectively, the amount of the mica dispersed solution (5 mass %) to be added was changed to 170 parts, the amount of the film hardening agent to be added was changed to 1.02 parts, and the mass ratio of PVA to the water swellable synthetic mica.

Example 3

A recording material was prepared in the same way as in Example 1, except that the partially saponified PVA was replaced by PVA210 (manufactured by Kuraray Co., Ltd., degree of saponification: 87 to 89%, and degree of polymerization: 1000), the ratio of the acetoacetyl denatured PVA to the partially saponified PVA was changed to 0.85/0.15, the amounts of the water and the methanol to be added to 100 parts of the PVA solution were changed to 51 parts and 110 parts, respectively, the amount of the mica dispersed solution (5 mass %) to be added was changed to 50 parts, the amount of the film hardening agent to be added was changed to 1.02 parts, and the mass ratio of the acetoacetyl denatured PVA to the water swellable synthetic mica was changed to 4 in the preparation of the coating solution for undercoat layer in Example 1.

Example 4

A recording material was prepared in the same way as in Example 1, except that the partially saponified PVA was replaced by PVA600 (manufactured by Kuraray Co., Ltd., degree of saponification: 74 to 80%, and degree of polymerization: 600), the ratio of the acetoacetyl denatured PVA to the partially saponified PVA was changed to 0.85/0.15, the amounts of the water and the methanol to be added to 100 parts of the PVA solution were changed to 75 parts and 70 parts, respectively, the amount of the mica dispersed solution (5 mass %) to be added was changed to 34 parts, the amount of the film hardening agent to be added was changed to 1.02 parts, and the mass ratio of the acetoacetyl denatured PVA to the water swellable synthetic mica was changed to 10 in the preparation of the coating solution for undercoat layer in Example 1.

Example 5

A recording material was prepared in the same way as in Example 1, except that the partially saponified PVA was replaced by PVA203 (manufactured by Kuraray Co., Ltd., degree of saponification: 86.5 to 89.5%, and degree of polymerization: 300), the ratio of the acetoacetyl denatured PVA to the partially saponified PVA was changed to 0.9/0.1, the amounts of the water and the methanol to be added to 100 parts of the PVA solution were changed to 106 parts and 39 parts, respectively, the amount of the mica dispersed solution (5 mass %) to be added was changed to 72 parts, the amount of the film hardening agent to be added was changed to 1.08 parts, and the mass ratio of the acetoacetyl denatured PVA to the water swellable synthetic mica was changed to 5 in the preparation of the coating solution for undercoat layer in Example 1.

Comparative Example 1

A recording material was prepared in the same way as in Example 1, except that the acetoacetyl denatured PVA was replaced by PVAC-506 (manufactured by Kuraray Co., Ltd., degree of saponification: 74 to 80%, and degree of polymerization: 600), the amounts of the water and the methanol to be added to 100 parts of the PVA solution were changed to 0 parts and 135 parts, respectively, the amount of the mica dispersed solution (5 mass %) to be added was changed to 180 parts, the amount of the film hardening agent to be added was changed to 1.08 parts, and the mass ratio of the acetoacetyl denatured PVA to the water swellable synthetic mica was changed to 2 in the preparation of the coating solution for undercoat layer in Example 1.

Comparative Example 2

A recording material was prepared in the same way as in Example 1, except that PVA110 (manufactured by Kuraray Co., Ltd., degree of saponification: 98 to 99%, and degree of polymerization: 1000) was used instead of the PVA506 of Comparative Example 1 , the amounts of the water and the methanol to be added to 100 parts of the PVA solution were changed to 135 parts and 0 parts, respectively, the amount of the mica dispersed solution (5 mass %) to be added was changed to 80 parts, the amount of the film hardening agent to be added was changed to 0.81 parts, and the mass ratio of PVA to the water swellable synthetic mica Examples of the Second Aspect of the Present Invention Example 6

(Preparation of Coating Solution for Undercoat Layer)

(1) Preparation of Acetoacetyl Denatured PVA Solution:

20 parts of acetoacetyl denatured PVA (degree of saponification: 99%, degree of polymerization: about 300, trade name: Goacefimer Z-100 (GFZ100), manufactured by Japan Synthetic Chemical Industrial Co., Ltd.), and 80 parts of water were added, and stirred and dissolved at 90° C. so as to form an acetoacetyl denatured PVA solution.

(2) Preparation of Mica Dispersed Solution:

Water swellable synthetic mica dispersed solution (aspect ratio: 1000, trade name: SOMASHIF MEB-3 (8% solution), manufactured by Co-op Chemical Co., Ltd., a dispersed solution of mica whose average particle diameter is 2.0 μm), and water were mixed such that the concentration of mica became 5 mass %, and the solution was mixed uniformly to obtain a mica dispersed solution.

(3) Film Hardening Agent:

A diol compound (2,3-hydroxy-5methyl-1,4 dioxane) (50%)

(4) 1.66 Mass % Solution of Ethylene Oxide Based Surfactant (Dissolved in Methanol)

Then, 39 parts water and 130 parts methanol were added to 100 parts of the above (1) 20 mass % acetoacetyl denatured PVA solution at 90° C., and the resultant solution was sufficiently stirred and mixed. Thereafter, 94.2 parts of the above (2) 5 mass % mica dispersed solution were added, the resultant mixture was sufficiently stirred and mixed, and 9.8 parts of the above (4) 1.66 mass % surfacetant solution was added. Next, the liquid temperature was maintained at 35° C. to 40° C., and 1.2 parts of the above (3) hardening agent was added, such that a coating solution for undercoat layer (6.81 mass %) was obtained.

While the obtained coating solution for undercoat layer was adjusted by using a gravure roller (#100 mesh, diagonal lines), such that the coated amount was 12.5 g/m$^2$ (total solids: 0.85 g/m$^2$), the coating solution was applied on a coating side of a support for a photographic printing paper so as to form the undercoat layer. The photographic printing paper was a high quality paper wherein each side thereof is laminated with a polyester film and a corona discharge was conducted on one side for the coating. At this time, the mass ratio of the acetoacetyl denatured PVA to the water swellable synthetic mica was 4.25.

(Formation of Recording Layer)

A multicolor heat-sensitive recording material was obtained in the same way as in Example 1, i.e., by using the same material and method as those in Example 1 except that the aforementioned coating solution for undercoat layer was used instead of the coating solution that was used in Example 1, such that the coating solution A for recording layer, the coating solution for intermediate layer, the coating solution B for recording layer, the coating solution for intermediate layer, the coating solution C for recording layer, the coating solution for the light transmittance adjusting layer, and the coating solution for the protective layer were sequentially coated such that the coated amounts of solids of the respective layers were the same as those in Example 1.

Example 7

A recording material was prepared in the same way as in Example 6, except that the mass ratio of the acetoacetyl denatured PVA to the water swellable synthetic mica was changed to 2. At this time, adjustment was conducted such that the coated amount of the coating solution for undercoat layer was 0.75 g/m$^2$.

Example 8

A recording material was prepared in the same way as in Example 6, except that the mass ratio of the acetoacetyl denatured PVA to the water swellable synthetic mica was changed to 10. At this time, adjustment was conducted such that the coated amount of the coating solution for undercoat layer was 1.0 g/m$^2$.

Comparative Example 3

A recording material was prepared in the same way as in Example 6, except that the acetoacetyl denatured PVA was replaced by PVA210 (manufactured by Kuraray Co., Ltd., degree of saponification: 87 to 89%, and degree of polymerization: 1000) and 1,2-bis (2', 3'-epoxypropoxy)ethane was used as the film hardening agent. At this time, the mass ratio of the PVA and the water swellable synthetic mica was 4.25. Adjustment was conducted such that and the coated amount of the PVA210 was 0.85 g/m$^2$.

Comparative Example 4

A recording material was prepared in the same way as in Example 6, except that the acetoacetyl denatured PVA was replaced by Goacefimer 210 (manufactured by Japan Synthetic Chemical Industrial Co., Ltd., degree of saponification: 96.5%, and degree of polymerization: 1000), and a boric acid was used as the film hardening agent. At this time, the mass ratio of the PVA and the water swellable synthetic mica was 5. Adjustment was carried out such that the coated amount of the Goacefimer 210 was 1.0 g/m$^2$.

Comparative Example 5

A recording material was prepared in the same way as in Comparative Example 3, except that no film hardening agent was used. At this time, the mass ratio of the PVA and the water swellable synthetic mica was 15. Adjustment was carried out such that the coated amount of the PVA210 was 0.75 g/m$^2$.

Comparative Example 6

A recording material was prepared in the same way as in Example 6, except that the coating solution for undercoat layer was changed to a "coating solution for undercoat layer provided for Comparative Example 6" described below, and was coated on the surface of the above support by using a gravure roller (#65 mesh, diagonal lines) such that the coated amount was about 21.0 g/m$^2$. At this time, the mass ratio of gelatin to the water swellable synthetic mica was 1/0.26, and adjustment was carried out such that the coated amount of the gelatin was 1 g/m$^2$.

(Preparation of Coating Solution for Undercoat Layer Relating to Comparative Example 6)

First, 40 parts of gelatin (degree of polymerization: about 10,000 or more; trade name: 881 GELATIN, manufactured by Nitta Gelatin KK) and 60 parts of water were added, and were stirred and dissolved at 40° C. so as to obtain a gelatin solution.

Separately, swellable synthetic mica dispersed solution (aspect ratio: 1000; trade name: SOMASHIF MEB-3 (8% solution), manufactured by Co-op Chemical Co., Ltd.: average particle diameter of this mica is 2.0 μm) was prepared. Water was added to this dispersed solution so that the concentration of the mica became 5%, and the mixture was stirred uniformly to obtain a mica dispersed solution.

Next, 31 parts water and 463 parts methanol were added to 100 parts of the above 40% gelatin solution at 40°, and sufficient stirring and mixing were carried out at 40°. Thereafter, 200 parts of the above 5% mica dispersed solution were added, sufficient mixing and stirring were carried out, and 10 parts of 1.66% surfactant solution were added. Next, the liquid temperature was maintained at 38° C. to 42° C., and 0.4 parts of a gelatin hardening agent was added, and a coating solution (6.3%) for undercoat layer relating to Comparative Example 6 was obtained.

Examples of the Third Aspect of the Present Invention

Example 9

(Preparation of Coating Solution for Undercoat Layer)

(1) Preparation of PVA Solution:

10 parts of acetoacetyl denatured PVA (degree of saponification: 99%, degree of polymerization: about 300, trade name: Goacefimer Z-100 (GFZ100), manufactured by Japan Synthetic Chemical Industrial Co., Ltd.), 20 parts of partially saponified PVA (degree of saponification: 74 to 80%, degree of polymerization: 600, trade name: C506, manufactured by Kuraray Co., Ltd.), and 80 parts of water were added, and stirred and dissolved at 90° C. so as to form a PVA solution.

(2) Preparation of Mica Dispersed Solution:

Water swellable synthetic mica dispersed solution (aspect ratio: 1000, trade name: SOMASHIF MEB-3 (8% solution), manufactured by Co-op Chemical Co., Ltd., and a dispersed solution of mica whose average particle diameter is 2.0 μm), and water were mixed such that the concentration of mica became 5 mass %, and the solution was mixed uniformly to obtain a mica dispersed solution.

(3) Film Hardening Agent:

A diol compound (2,3-hydroxy-5methyl-1,4 dioxane) (50%)

(4) 1.66 Mass % Solution of Sthylene oxide based surfactant (dissolved in Methanol Solution)

Then, 59 parts water and 377 parts methanol were added to 100 parts of the above (1) 20 mass % acetoacetyl denatured PVA solution at 90° C., and the resultant solution was sufficiently stirred and mixed. Thereafter, 208 parts of the above (2) 5 mass % mica dispersed solution was added, the resultant mixture was sufficiently stirred and mixed, and 9.8 parts of the above (4) a 1.66 mass % surfactant solution was added. Next, the liquid temperature was maintained at 35° C. to 40° C., and 1 part of the above (3) film hardening agent was added, such that a coating solution for undercoat layer (6.83 mass %) was obtained. The viscosity of the coating solution for undercoat layer was 0.134 Pa·s.

While the obtained coating solution for undercoat layer was adjusted by a gravure roller (#100 mesh, diagonal lines) such that the wet coated amount was 12.5 g/m$^2$ (total solids: 0.85 g/m$^2$), the coating solution was applied on a coating side of a support for a photographic printing paper in which a polyester film was laminated on each side of a high quality paper and a corona discharge was conducted on the coating side, so as to form the undercoat layer. At this time, the mass ratio of the acetoacetyl denatured PVA to the water swellable synthetic mica was 3.85.

[Formation of Recording Layer]

A multicolor heat-sensitive recording material was obtained in the same way as in Example 1, i.e., by using the same material and method as those in Example 1 except that the aforementioned coating solution for undercoat layer was used instead of the coating solution that was used in Example 1, such that the coating solution A for recording layer, the coating solution for intermediate layer, the coating solution B for recording layer, the coating solution for intermediate layer, the coating solution C for recording layer, the coating solution for the light transmittance adjusting layer, and the coating solution for the protective layer were sequentially coated, on the support for the photographic printing plate having the undercoat layer formed thereon, such that the coated amounts of solids of the respective layers were the same as those in Example 1.

Example 10

A recording material was prepared in the same way as in Example 9, except that the mixing ratio of the acetoacetyl denatured PVA to the partially saponified PVA was changed to 0.85/0.15, the mass ratio of the acetoacetyl denatured PVA to the water swellable synthetic mica was changed to 2, the proportion (mass ratio) of methanol contained in the solvent was 40%, and the obtained coating solution was coated by a gravure roller (mesh, diagonal lines) such that the coated amount of solids was 0.85 g/m$^2$. Further, the viscosity of the coating solution for undercoat layer was 0.252 Pa·s.

Example 11

A recording material was prepared in the same way as in Example 9, except that the mixing ratio of the acetoacetyl denatured PVA to the partially saponified PVA was changed to 0.85/0.15, the mass ratio of the acetoacetyl denatured PVA to the water swellable synthetic mica was changed to 4.25, the proportion (mass ratio) of methanol contained in the solvent was 40%, and the coating solution was coated by a gravure roller (mesh, diagonal lines) such that the coated amount of solids was 0.85 g/m$^2$. Further, the viscosity of the coating solution for undercoat layer was 0.185 Pa·s.

Example 12

A recording material was prepared in the same way as in Example 9, except that the mixing ratio of the acetoacetyl denatured PVA to the partially saponified PVA was changed to 0.85/0.15, the mass ratio of the acetoacetyl denatured PVA and the water swellable synthetic mica was changed to 10, the coating solution was coated by a gravure roller (mesh, diagonal lines) such that the coated amount of solids was 0.85 g/m$^2$, and the proportion (mass ratio) of methanol contained in the solvent was 40%. Further, the viscosity of the coating solution for undercoat layer was 0.152 Pa·s.

Example 13

A recording material was prepared in the same way as in Example 9, except that the mixing ratio of the acetoacetyl denatured PVA to the partially saponified PVA was changed to 0.9/0.1, the mass ratio of the acetoacetyl denatured PVA and the water swellable synthetic mica was changed to 5, the coating solution was coated by a gravure roller (mesh, diagonal lines) such that the coated amount of solids was 0.85 g/m$^2$, and the proportion (mass ratio) of methanol contained in the solvent was 25%. Further, the viscosity of the coating solution for undercoat layer was 0.276 Pa·s.

Comparative Example 7

A recording material was prepared in the same way as in Example 9, except that the acetoacetyl denatured PVA was not used but PVA506 only was used, the mass ratio of PVA and the water swellable synthetic mica was changed to 2, and the proportion (mass ratio) of methanol contained in the solvent was 60%. Further, the viscosity of the coating solution for undercoat layer was 0.260 Pa·s.

Comparative Example 8

A recording material was prepared in the same way as in Comparative Example 7, except that PVA506 in Comparative Example 7 was replaced by PVA110 (manufactured by Kuraray Co., Ltd., degree of saponification: 98 to 99%, and degree of polymerization: 1000), the mass ratio of the PVA and the water swellable synthetic mica was changed to 5, and methanol was not contained in the solvent. Further, the viscosity of the coating solution for undercoat layer was 0.695 Pa·s.

Examples of the Fourth Aspect of the Present Invention

Example 14

<Preparation of Coating Solution for Undercoat Layer>

(1) Preparation of Acetoacetyl Denatured PVA Solution:

12.85 parts of acetoacetyl denatured PVA (degree of saponification: 95 to 97%, degree of polymerization: 1000, trade name: Goacefimer Z-210, manufactured by Japan Synthetic Chemical Industrial Co., Ltd.) and 87.15 parts of water were added, and stirred and dissolved at 90° C. so as to form a PVA solution.

(2) Preparation of Mica Dispersed Solution:

Water swellable synthetic mica dispersion solution (aspect ratio: 1000, trade name: SOMASHIF MEB-3 (8% solution), manufactured by Co-op Chemical Co., Ltd., and a dispersed solution of mica whose average particle diameter is 2.0 μm), and water were mixed such that the concentration of mica became 5 mass %, and the solution was mixed uniformly to obtain a mica dispersed solution.

(3) 1.66 Mass % Solution of Ethylene Oxide Based Surfactant (Dissolved in Methanol Solution)

Then, 3.019 parts water and 84.954 parts methanol were added to 100 parts of the above (1) 20 mass % acetoacetyl denatured PVA solution at 90° C., and the resultant solution was sufficiently stirred and mixed. Thereafter, 18.897 parts of the above (2) 8 mass % mica dispersed solution was added, the resultant mixture was sufficiently stirred and mixed, and 3.096 parts of the above (3) 1.66% mass surfactant solution was added. Next, the liquid temperature was maintained at 30° C. to 35° C., such that a coating solution (6.86 mass %) for undercoat layer was obtained.

While the obtained coating solution for undercoat layer was adjusted by a gravure roller (#100 mesh, diagonal lines) such that the coated amount was 12.5 g/m$^2$ (0.858 g/m$^2$), the coating solution was applied on a coating side of a support for a photographic printing paper, in which a polyester film was laminated on each side of a high quality paper and a corona discharge was conducted on the coating side, so as to form the undercoat layer. At this time, the mass ratio of the acetoacetyl denatured PVA to the water swellable synthetic mica was 8.5.

[Formation of Recording Layer]

A multicolor heat-sensitive recording material was obtained in the same way as in Example 1, i.e., by using the same material and method as those in Example 1 except that the aforementioned coating solution for undercoat layer was used instead of the coating solution that was used in Example 1, such that the coating solution A for recording layer, the coating solution for intermediate layer, the coating solution B for recording layer, the coating solution for intermediate layer, the coating solution C for recording layer, the coating solution for the light transmittance adjusting layer, and the coating solution for the protective layer were sequentially coated, on the support for the photographic printing plate having the aforementioned undercoat layer formed thereon, such that the coated amounts of solids of the respective layers were the same as those in Example 1.

Example 15

A recording material was prepared in the same way as in Example 14, except that the amounts of the water and the methanol to be added to 100 parts of the PVA solution were both changed to 1436.196 parts, the amount of the mica dispersed solution to be added was changed to 16.063 parts, and the mass ratio of the acetoacetyl denatured PVA to the water swellable synthetic mica was changed to 10.0 in the preparation of the coating solution for undercoat layer in Example 14. The concentration of the coating solution for undercoat layer of Example 15 was 0.44 mass %.

Example 16

A recording material was prepared in the same way as in Example 14, except that the amounts of the water and the methanol to be added to 100 parts of the acetoacetyl denatured PVA solution were both changed to 2.021 parts, the amount of the mica dispersed solution to be added was changed to 6.425 parts, and the mass ratio of the acetoacetyl denatured PVA and the water swellable synthetic mica was changed to 25.0 in the preparation of the coating solution for undercoat layer in Example 1. The concentration of the coating solution for undercoat layer of Example 16 was 11.69 mass %.

Example 17

A recording material was prepared in the same way as in Example 14, except that the amounts of the water and the methanol to be added to 100 parts of the acetoacetyl denatured PVA solution were both changed to 1193.910 parts, the amount of the mica dispersed solution to be added was changed to 53.542 parts, and the mass ratio of the acetoacetyl denatured PVA and the water swellable synthetic mica was changed to 3.0 in the preparation of the coating solution for undercoat layer in Example 14. The concentration of the coating solution for undercoat layer of Example 17 was 0.64 mass %.

Example 18

A recording material was prepared in the same way as in Example 14, except that the amounts of the water and the methanol to be added to 100 parts of the acetoacetyl denatured PVA solution were both changed to 41.280 parts, the amount of the mica dispersed solution to be added was changed to 160.625 parts, and the mass ratio of the acetoacetyl denatured PVA to the water swellable synthetic mica was changed to 1.0 in the preparation of the coating solution for undercoat layer in Example 14. The concentration of the coating solution for undercoat layer of Example 18 was 8.02 mass %.

Example 19

A recording material was prepared in the same way as in Example 14 except that the acetoacetyl denatured PVA was replaced by Goacefimer Z-320 (manufactured by Japan Synthetic Chemical Industrial Co., Ltd., degree of saponification: 92 to 94%, and degree of polymerization: about 2000), the water and the methanol to be added to 100 parts of the acetoacetyl denatured solution were changed to 122.423 parts and 69.498 parts, respectively, the amount of the mica dispersed solution to be added was changed to 6.425 parts, and the mass ratio of the acetoacetyl denatured PVA to the water swellable synthetic mica was changed to 25.0 in the preparation of the coating solution for undercoat layer of Example 14. The concentration of the coating solution for undercoat layer of Example 19 was 4.18 mass %.

Comparative Example 9

A recording material was prepared in the same way as in Example 14 except that the acetoacetyl denatured PVA was replaced by PVA203 (manufactured by Kuraray Co., Ltd., degree of saponification: 88%, and degree of polymerization: about 300), the water and the methanol to be added to 100 parts of the PVA solution were both changed to 171.708 parts, the amount of the mica dispersed solution to be added was changed to 4.016 parts, and the mass ratio of the PVA to the water swellable synthetic mica was changed to 40.0 in the preparation of the coating solution for undercoat layer of Example 14. The concentration of the coating solution for undercoat layer of Comparative Example 9 was 3.29 mass %.

Comparative Example 10

A recording material was prepared in the same way as in Example 14 except that the acetoacetyl denatured PVA was replaced by PVA210 (manufactured by Kuraray Co., Ltd., degree of saponification: 88%, and degree of polymerization: about 1000), the water and the methanol to be added to 100 parts of the PVA solution were both changed to 84.954 parts, the amount of the mica dispersed solution to be added was changed to 18.890 parts, and the mass ratio of the PVA to the water swellable synthetic mica was changed to 8.5 in the preparation of the coating solution for undercoat layer of Example 14. The concentration of the coating solution for undercoat layer of Comparative Example 10 was 6.86 mass %.

Comparative Example 11

A recording material was prepared in the same way as in Example 14 except that the acetoacetyl denatured PVA was replaced by PVA104 (manufactured by Kuraray Co., Ltd., degree of saponification: 98.5%, and degree of polymerization: about 500), the water and the methanol to be added to 100 parts of the PVA solution were both changed to 6.733 parts, the amount of the mica dispersed solution to be added was changed to 18.897 parts, and the mass ratio of the PVA to the water swellable synthetic mica was changed to 8.5 in the preparation of the coating solution for undercoat layer of Example 14. The concentration of the coating solution for undercoat layer of Comparative Example 11 was 6.86 mass %.

Evaluations

A description of Evaluations will be made hereinafter.

(Gravure Coated Surface State)

If the viscosity of the coating solution for undercoat layer at 40° C. is 0.1 to 0.3 Pa·s, gravure marks or coating stripes hardly occurred. If the viscosity is 0.5 Pa·s or more, vertical coating stripes or gravure marks easily occurred. If the viscosity is less than 0.1 Pa·s, weak gravure marks and coating defects in a state of raindrops occurred. The gravure coated surface was immersed and dyed in Pilot Ink Blue Black, a case in which the generation of gravure marks and the coated surface in the state of raindrops was not observed was represented by ○, while a case in which the generation thereof was observed is represented by X.

(Evaluation of Blistering)

With the conditions shown in following Table 1 as maximum output, the output was successively lowered, and for each output, a black solid mark was recorded on comparative samples (THERMO-AUTOCHROME PAPER RA 5-G100, manufactured by Fuji Photo Film Co., Ltd.) by using a digital printer. Next, each of the comparative samples was viewed by a transmissible microscope, and the state of generation of blistering was measured.

A mark of 1 point was given to the surface state level of a comparative sample which was recorded at the maximum output and at which there was the most blistering. A mark of 5 points was given to the surface state level of a comparative sample at which no generation of blistering at all was observed. Marks of 2 through 4 points were appropriately given to surface state levels of comparative samples which were recorded at outputs between the highest output of the comparative sample at which no blistering at all was observed, and the maximum output. Evaluations of 3 points or more denote surface state levels which do not present problems in practice.

Next, the recording materials of Examples 1 through 19 and Comparative Examples 1 through 11, on which black solid marks were recorded in the above same manner as the above blister test were prepared. The recording materials were cut, the cut surfaces thereof were viewed, and the states of generation of blistering were measured. These cut recording materials were compared with the comparative samples, and were evaluated and given the surface state level of the comparative sample which has the closest state of generation of blistering of each of the cut recording materials. The evaluations of the respective recording materials are shown in Tables 2 to 5.

TABLE 1

| | Line period | Applied voltage | Energization time |
|---|---|---|---|
| Yellow | 7.6 ms/line | 19 V | 4167 μs |
| Magenta | 7.6 ms/line | 21 V | 5320 μs |
| Cyan | 13.3 ms/line | 22 V | 8031 μs |

(Evaluation of Water Resistance)

After images were formed on each of the recording materials in Examples 1 to 13 and Comparative Examples 1 to 8, each recording material was immersed in water for 24 hours at 20° C. and it was observed whether peeling-off of film, shrinkage of the coated film, or shrinkage of edges of the film has occurred, and evaluation was carried out in accordance with the following criteria.

-Criteria-

○: There was absolutely neither peeling-off of film nor shrinkage of the coated film.

Δ: There was slight shrinkage of edges of the coated film.

X: Peeling-off of a portion of the coated film was observed.

(Evaluation of Dryability)

Immediately after the coating solution for undercoat layer was coated on a support, the coated support was heated in an oven at 100° C. and the dryability of the surface of the support was examined, and evaluation was carried out in accordance with the following criteria.

-Criteria-

◎: The support was uniformly and completely dried by being heated for 10 seconds.

○: The support was uniformly and completely dried by being heated for 12 seconds.

Δ: The support was uniformly and completely dried by being heated for 15 seconds.

X: The support was not completely dried by being heated for 15 seconds.

(Oxygen Permeation)

An oxygen transmittance coefficient P was determined by an electroding method for each recording material in Examples 6 to 8 and Comparative Examples 3 to 6 to evaluate oxygen permeation. The oxygen transmittance coefficient P is represented by the following equation:

$$P=E\infty l/4FARP_s$$

E∞ represents a constant voltage value, F represents a Faraday constant, A represents a cathode area, $P_s$ represents oxygen partial pressure, R represents an internal resistance, and l represents film thickness.

Table 4 shows resultant values of E∞. When the value of E∞ is 0.3 mV or less, the oxygen permeation is low and practical.

(Evaluation of Crack Due to Low Humidity)

Samples of the recording materials each of which width is 3 cm and length is 30 cm was prepared in Examples 14 through 19 and Comparative Examples 9 through 11. First, humidity adjustment of the sample was sufficiently conducted for 7 days or more at the temperature of 20° C. and in an atmosphere of 10% RH. Then, test equipment was prepared which comprises a first opening portion which is formed into a rectangular shape and whose widthwise directional length is 2 mm, and a second opening portion which is opposite to and communicates with the first opening portion and in which the first opening portion in the widthwise direction is structured to become larger at an angle of 15° toward the second opening portion. Each sample was inserted from the second opening portion of the tester such that longitudinal directional ends of the sample correspond to those ends of the test equipment, and eventually pulled out from the first opening portion, and a distance at which cracks occurred (between the first opening portion and the terminal end of the sample) was measured, and evaluation was carried out in accordance with the following criteria, and results were shown in Table 5.

-Criteria-

◎: A distance of less than 50 mm.
○: A distance of 50 mm or more and less than 70 mm.
Δ: A distance of 70 mm or more and less than 80 mm.
X: A distance of 80 mm or more.

TABLE 2

| | Mixing Ratio | Mass Ratio of Acetoacetyl Denatured PVA to Mica | Proportion of Contained Methanol (%) | Viscosity (40° C.) (Pa · s) | Concentration of Coating Solution (%) | Gravure Coated Surface State | Evaluation of Blistering | Water Proof | Dryability |
|---|---|---|---|---|---|---|---|---|---|
| Example 1 | GFZ100/PVA-205 = 0.5/0.5 | 5 | 39.9 | 0.141 | 9.07 | ○ | 5 | ○ | ◎ |
| Example 2 | GFZ100/PVA-205 = 0.85/0.15 | 2 | 31.0 | 0.220 | 7.02 | ○ | 5 | ○ | ○ |
| Example 3 | GFZ100/PVA-210 = 0.85/0.15 | 4 | 40.1 | 0.245 | 7.20 | ○ | 4 | ○ | ○ |
| Example 4 | GFZ100/PVA-506 = 0.85/0.15 | 10 | 29.8 | 0.150 | 7.72 | ○ | 5 | ○ | ○ |
| Example 5 | GFZ100/PVA-203 = 0.9/0.1 | 5 | 16.0 | 0.186 | 7.41 | ○ | 5 | ○ | Δ |
| Comparative Example 1 | PVAC-506 | 2 | 36.5 | 0.260 | 6.97 | ○ | 5 | X | ◎ |
| Comparative Example 2 | PVA-110 | 5 | 0 | 0.695 | 7.06 | X | 1 | X | X |

TABLE 3

| | Trade Name | Degree of Saponification (mol %) | Degree of Polymerization | Coated Amount (g/m²) | PVA (gelatin)/Mica Ratio | Evaluation of Blistering | Water resistance: Film Hardening Agent | Water resistance: Added Amount to PVA (mass %) | Water resistance: Water Proof | Coated Surface State | Oxygen Permeation (mV) |
|---|---|---|---|---|---|---|---|---|---|---|---|
| Example 6 | Goacefimer Z100 | 99 | About 300 | 0.85 | 4.25 | 5 | 2,3-dihydroxy-5-methyl-1,4-dioxane | 1 | ○ | ○ | 0.12 |
| Example 7 | Goacefimer Z100 | 99 | About 300 | 0.75 | 2 | 5 | 2,3-dihydroxy-5-methyl-1,4-dioxane | 3 | ○ | ○ | 0.10 |
| Example 8 | Goacefimer Z100 | 99 | About 300 | 1.0 | 10 | 5 | 2,3-dihydroxy-5-methyl-1,4-dioxane | 1 | ○ | ○ | 0.10 |
| Comp. Example 3 | PVA-210 | 88 | 1000 | 0.85 | 4.25 | 3.5 | 1,2-bis (2',3'-epoxyproxy) ethane | 3 | X | ○ | 0.18 |

TABLE 3-continued

| | Trade Name | Degree of Saponification (mol %) | Degree of Polymerization | Coated Amount (g/m$^2$) | PVA (gelatin)/Mica Ratio | Evaluation of Blistering | Water resistance: Film Hardening Agent | Water resistance: Added Amount to PVA (mass %) | Water resistance: Water Proof | Coated Surface State | Oxygen Permeation (mV) |
|---|---|---|---|---|---|---|---|---|---|---|---|
| Comp. Example 4 | Goacefimer Z100 | 95 | 1000 | 1.0 | 5 | 5 | boric acid | 5 | Δ | X | 0.08 |
| Comp. Example 5 | PVA-210 | 99 | 1000 | 0.75 | 15 | 3 | none | 0 | X | ○ | 0.35 |
| Comp. Example 6 | 881 GELATIN | — | 10000 (molecular weight) | 1 | 1/0.25 | 1 | 1,2-bis(2',3'-epoxyproxy) ethane | 1 | ○ | ○ | 0.18 |

TABLE 4

| | Mixing Ratio | Mass Ratio of Acetoacetyl Denatured PVA to Mica | Proportion of Contained Methanol (%) | Viscosity (40° C.) (Pa · s) | Gravure Coated Surface State | Evaluation of Blistering | Water Proof | Dryability |
|---|---|---|---|---|---|---|---|---|
| Example 9 | GFZ100/C506 = 0.5/0.5 | 5 | 70 | 0.134 | ○ | 5 | ○ | ◎ |
| Example 10 | GFZ100/C506 = 0.85/0.15 | 2 | 40 | 0.252 | ○ | 5 | ○ | ○ |
| Example 11 | GFZ100/C506 = 0.85/0.15 | 4.25 | 40 | 0.185 | ○ | 5 | ○ | ○ |
| Example 12 | GFZ100/C506 = 0.85/0.15 | 10 | 40 | 0.152 | ○ | 5 | ○ | ○ |
| Example 13 | GFZ100/C506 = 0.9/0.1 | 5 | 25 | 0.276 | ○ | 5 | ○ | Δ |
| Comp. Example 7 | PVAC-506 | 2 | 60 | 0.260 | ○ | 5 | X | ◎ |
| Comp. Example 8 | PVA-110 | 5 | 0 | 0.695 | X | 1 | X | X |

TABLE 5

| | Trade Name | Degree of Polymerization | Degree of Saponification (mol %) | Mass Ratio of PVA/Mica | Coated Amount of PVA | Coated Amount of Mica | Evaluation of Blistering | Evaluation of Cracking at Low Humidity | Coated Surface State |
|---|---|---|---|---|---|---|---|---|---|
| Example 14 | Goacefimer-Z210 | 1000 | 95 to 97 | 8.5 | 0.765 | 0.090 | 5 | ◎ | ○ |
| Example 15 | Goacefimer-Z210 | 1000 | 95 to 97 | 10.0 | 0.050 | 0.005 | 5 | ◎ | ○ |
| Example 16 | Goacefimer-Z210 | 1000 | 95 to 97 | 25.0 | 1.400 | 0.056 | 5 | ◎ | ○ |
| Example 17 | Goacefimer-Z210 | 1000 | 95 to 97 | 3.0 | 0.060 | 0.020 | 5 | ◎ | ○ |
| Example 18 | Goacefimer-Z210 | 1000 | 95 to 97 | 1.0 | 0.500 | 0.500 | 5 | ○ | ○ |
| Example 19 | Goacefimer-Z320 | 2000 | 92 to 94 | 25.0 | 0.500 | 0.020 | 5 | ◎ | ○ |
| Comparative. Example 9 | PVA-203 | 300 | 88 | 40.0 | 0.400 | 0.010 | 3 | X | ○ |
| Comparative Example 10 | PVA-210 | 1000 | 88 | 8.5 | 0.765 | 0.090 | 3 | Δ | X |
| Comparative Example 11 | PVA-105 | 500 | 98.5 | 8.5 | 0.765 | 0.090 | 2 | X | ○ |

It can be seen from Tables 2 and 4 that, in the recording materials of Examples 1 to 5, and 9 to 13, blistering scarcely occurred, water-resistance and dryability were good, and the state of the gravure-coated surface of a support was good, while simultaneously, all of the evaluations corresponding to recording materials of Comparative Examples 1, 2, 7, and 8 did not show good results.

It can be seen from Table 3 that, in the recording materials of Examples 6 to 8, blistering scarcely occurred, and water-resistance and the coated surface state were good, while simultaneously, all of the evaluations corresponding to the recording materials in Comparative Examples 3 to 6 did not show good results.

It can be seen from Table 5 that, in the recording materials of Examples 14 to 19, blistering scarcely occurred, the generation of cracking was suppressed in an atmosphere of low humidity, and the coated surface state was good, while simultaneously, all of the evaluations corresponding to recording materials in Comparative Examples 9 to 11 did not show good results.

As described above, in accordance with the first to third aspects of the present invention, a recording material in which the generation of blistering during image recording can be suppressed, and which enables formation of flat surface at imaging portions and has high water resistance, whereby images with high quality and excellent glossiness can be formed.

Further, in accordance with the fourth aspect of the present invention, a recording material in which the generation of blistering during image recording can be suppressed, cracks are prevented from being produced in an atmosphere of low humidity, whereby images with high quality and excellent glossiness can also be formed.

What is claimed is:

1. A recording material comprising a support, having disposed thereon a recording layer which forms a color when at least one of heat and pressure is applied thereto;

wherein at least one layer is disposed between the support and the recording layer, said at least one layer comprising acetoacetyl denatured polyvinyl alcohol, partially saponified polyvinyl alcohol and a film hardening agent.

2. The recording material according to claim 1, wherein the film hardening agent is a diol compound.

3. The recording material according to claim 1, wherein a ratio of the acetoacetyl denatured polyvinyl alcohol to the partially saponified polyvinyl alcohol is from 0.5/0.5 to 0.9/0.1.

4. The recording material according to claim 1, wherein a degree of polymerization of the acetoacetyl denatured polyvinyl alcohol is no more than 1000, and a degree of saponification and a degree of polymerization of the partially saponified polyvinyl alcohol are from 70 to 90% and no more than 1000, respectively.

5. The recording material according to claim 1, wherein the support comprises a paper substrate each side of which paper substrate is laminated with polyolefine and the at least one layer and the support are adjacent to each other.

6. The recording material according to claim 5, wherein the polyolefine is polyethylene.

7. The recording material according to claim 1, wherein the at least one layer further comprises a laminar inorganic compound.

8. The recording material according to claim 7, wherein the laminar inorganic compound is water swellable synthetic mica, and a mass ratio of the acetoacetyl denatured polyvinyl alcohol to the water swellable synthetic mica is in a range of from 2 to 10.

9. A recording material comprising a support, having disposed thereon a recording layer which forms a color when at least one of heat and pressure is applied thereto;

wherein at least one layer is disposed between the support and the recording layer, said at least one layer comprising acetoacetyl denatured polyvinyl alcohol and a film hardening agent.

10. The recording material according to claim 9, wherein a degree of polymerization of the acetoacetyl denatured polyvinyl alcohol is no more than 1000.

11. The recording material according to claim 9, wherein said film hardening agent is a diol compound.

12. The recording material according to claim 9, wherein the support comprises a paper substrate, each side of which paper substrate is laminated with polyolefine, and the at least one layer and the support are adjacent to each other.

13. The recording material according to claim 12, wherein the polyolefine is polyethylene.

14. The recording material according to claim 9, wherein the at least one layer further comprises a laminar inorganic compound.

15. The recording material according to claim 14, wherein the laminar inorganic compound is water swellable synthetic mica in which a mass ratio of the acetoacetyl denatured polyvinyl alcohol to the water swellable synthetic mica is from 2 to 10.

16. A recording material comprising a support, having disposed thereon a recording layer which forms a color when at least one of heat and pressure is applied thereto;

wherein at least one layer is disposed between the support and the recording layer, said at least one layer comprising acetoacetyl denatured polyvinyl alcohol, partially saponified polyvinyl alcohol and a film hardening agent, said layer being formed by coating, with a gravure roller, a coating solution having a viscosity of no more than 0.3 Pa·s at 40° C.

17. The recording material according to claim 16, wherein a ratio of the acetoacetyl denatured polyvinyl alcohol to the partially saponified polyvinyl alcohol is from 0.5/0.5 to 0.9/0.1, and a degree of saponification of the partially saponified polyvinyl alcohol is no more than 90%.

18. The recording material according to claim 16, wherein the film hardening agent is a diol compound.

19. The recording material of claim 16, wherein the coating solution comprises a solvent including alcohol, wherein the alcohol is included in an amount of at least 20%.

20. The recording material according to claim 19, wherein the alcohol is methanol.

21. The recording material according to claim 16, wherein the layer containing therein the acetoacetyl denatured polyvinyl alcohol and the film hardening agent further comprises a laminar inorganic compound.

22. The recording material according to claim 16, wherein the laminar inorganic compound is water swellable synthetic mica, and a mass ratio of the acetoacetyl denatured polyvinyl alcohol to the water swellable synthetic mica is in a range of from 2 to 10.

* * * * *